US006772561B1

(12) United States Patent
Berger, Jr.

(10) Patent No.: US 6,772,561 B1
(45) Date of Patent: Aug. 10, 2004

(54) GARAGE DOOR TRIM ASSEMBLY WITH REMOVABLE SEALING ELEMENT

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 0 days.

(21) Appl. No.: 10/320,878

(22) Filed: Dec. 18, 2002

(51) Int. Cl.[7] ..... E06B 7/232
(52) U.S. Cl. ..... 49/496.1; 49/475.1; 160/40
(58) Field of Search ..... 49/475.1, 496.1, 49/197, 493.1, 482.1; 160/40

(56) References Cited

U.S. PATENT DOCUMENTS

| | | | | |
|---|---|---|---|---|
| 1,581,811 A | | 4/1926 | Rubin | |
| 2,613,844 A | * | 10/1952 | Mounce | 220/345.6 |
| 2,724,876 A | * | 11/1955 | Chagnon | 49/493.1 |
| 3,184,808 A | * | 5/1965 | Lyon | 49/493.1 |
| 3,453,780 A | | 7/1969 | Thompson | |
| 3,535,824 A | * | 10/1970 | Kessler | 49/475.1 |
| 4,246,304 A | * | 1/1981 | Dixon | 428/34.1 |
| 4,525,953 A | * | 7/1985 | Stutzman | 49/493.1 |
| 4,643,239 A | * | 2/1987 | Wentzel | 160/201 |
| 4,931,339 A | * | 6/1990 | Malcolm-Brown | 428/71 |
| 4,957,301 A | * | 9/1990 | Clay et al. | 277/345 |
| 5,009,036 A | * | 4/1991 | Ryan | 49/489.1 |
| 5,129,194 A | * | 7/1992 | Grimsdale | 49/493.1 |
| 5,435,104 A | * | 7/1995 | Dietrich | 49/493.1 |
| 5,784,834 A | | 7/1998 | Stutzman | |
| 6,167,657 B1 | * | 1/2001 | Burge et al. | 49/496.1 |
| 6,374,567 B1 | * | 4/2002 | Mullet | 52/716.1 |

* cited by examiner

*Primary Examiner*—Gregory J. Strimbu
(74) *Attorney, Agent, or Firm*—J. Sanchelima; A. Bordas

(57) ABSTRACT

A trim assembly (20) having a longitudinally extending housing (21) that is mounted against a structure or wall (W) adjacent to a movable garage door (D). The housing includes a longitudinal bay (22) in a first longittudinally extending wall (27). A longitudinally extending sealing member (30) is removably mounted to the bay (22) at one longitudinally extending side (32) thereof and the distal longitudinal side (34) of the sealing member coacts with the garage door (D) to provide a sealing slidable engagement thereon. The sending member (30) is made out of resilient material such as rubber. A longitudinal slot (28) is provided on a second wall (23) of the housing (21) opposite the first wall. The first wall including cooperating through openings (26) aligned with the slot to permit fastening members (40) to go through.

4 Claims, 2 Drawing Sheets

GARAGE DOOR TRIM ASSEMBLY WITH REMOVABLE SEALING ELEMENT

BACKGROUND OF THE INVENTION

1. Field of the Invention.

The present invention relates to a trim assembly with a removable sealing element, and more particularly, to such as an assembly that is used with garage doors.

2. Description of the Related Art.

Many inventions for trim assemblies have been developed in the past. None of them, however, includes a removable sealing member mounted to a one-piece roll formed trim assembly in close proximity to the garage door. The sealing member has resilient characteristics and its longitudinal distal end presses against the garage door. Being exposed to the elements, the sealing member of the present invention can be readily replaced from the trim assembly when it deteriorates. The fact that the present invention is roll-formed keeps its production cost low. Also, the fact that the sealing member is readily removable makes it more effective and desirable.

Applicant believes that the closest reference corresponds to U.S. Pat. No. 5,784,834 issued to Stutzman on Jul. 28, 1998 for a door seal. Stutzman's door seal includes a rigid base portion fastened to a support frame and a flexible combination cover and flap portion made of a plastic material that is integral with the base portion. The cover and flap portion extend over outer front end and rear end faces of the base at an angle from the front corner along the outer face of the base portion. The flap extends forwardly and outwardly at an angle beyond the front end face of the base portion. However, it differs from the present invention because in the present trim assembly the sealing member can be slidably mounted along a roll formed longitudinal bay. The longitudinally extending distal side of the sealing member coacts with the door in a cooperative longitudinally sealing engagement thereon.

Applicant believes that another related reference corresponds to U.S. Pat. No. 3,453,780 issued to Thompson on Jul. 8, 1969 for a weather sealing insert for doors. Thompson's sealing includes a sealing for installation in a groove along the bottom edge of a door with a flexible longitudinally ribbed sealing member having a rigid core and an integral resilient section with adjustment screws engaging angular portions of the resilient core. Thompson's sealing differs from the present invention because in the present trim assembly the sealing member is not mounted to the door and is intended to seal the bottom clearance of the door. In the present invention, the removable sealing member is cooperatively mounted to a roll-formed longitudinal bay in the housing to coact with the garage door.

Applicant believes that another reference corresponds to U.S. Pat. No. 1,581,811 issued to Rubin on Apr. 20, 1926 for a sealing construction. Rubin's adjustable sealing includes a base or supporting member with two longitudinally extending grooves positioned in two transversely positioned faces. One of the grooves carries a longitudinally extending sealing strip projecting outwardly from the slot in which it is anchored into engagement with the door. An L-shaped clamp is adapted to engage the supporting base. Rubin's sealing construction differs from the present invention because in the present assembly the sealing member is at an angle with respect to the door and it is slidably mounted along a roll formed longitudinal bay in the elongated trim assembly, which in turn is directly mounted to the wall.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a trim assembly with a removable sealing member cooperatively mounted to coact with a garage door.

It is another object of this invention to provide a trim assembly that includes a sealing member that can be readily replaced.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
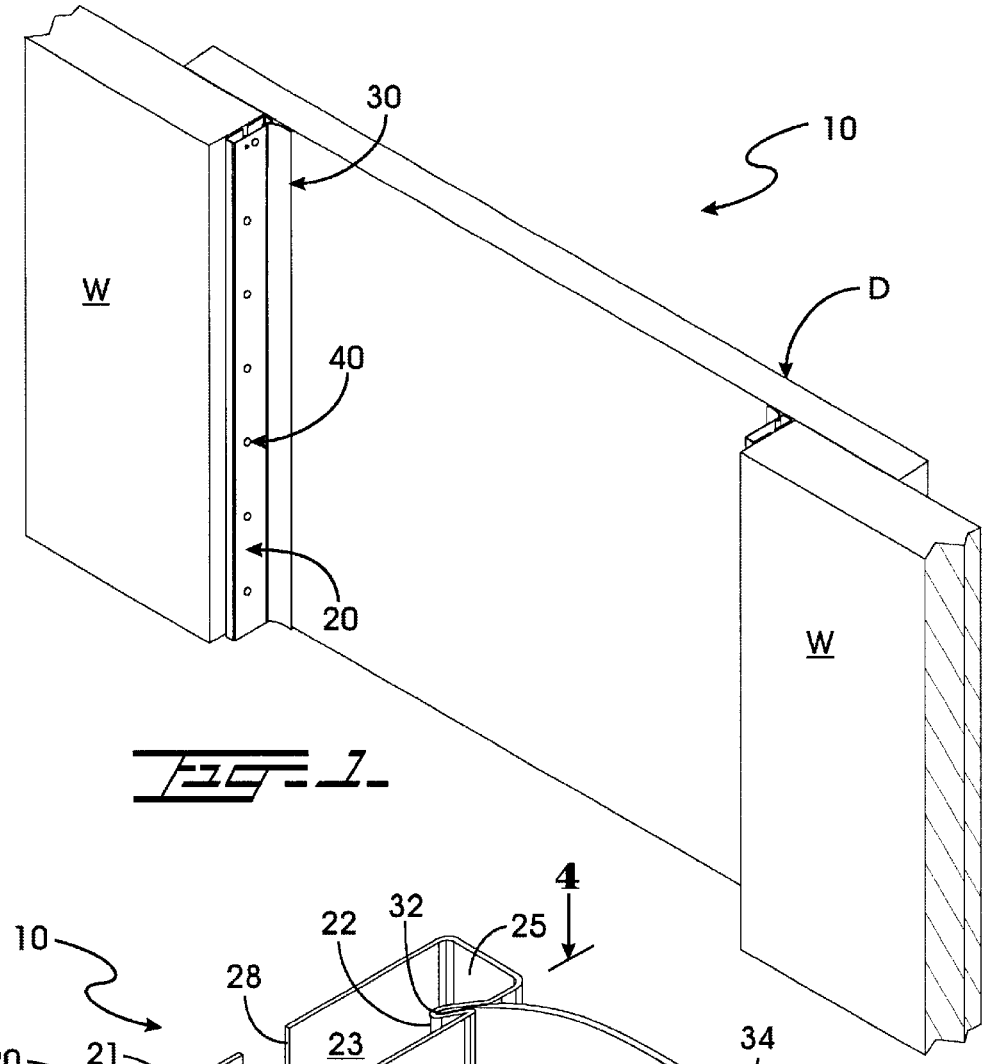
FIG. 1 represents an isometric view of the trim assembly with removable sealing element, object of the present application.
Figure 2:
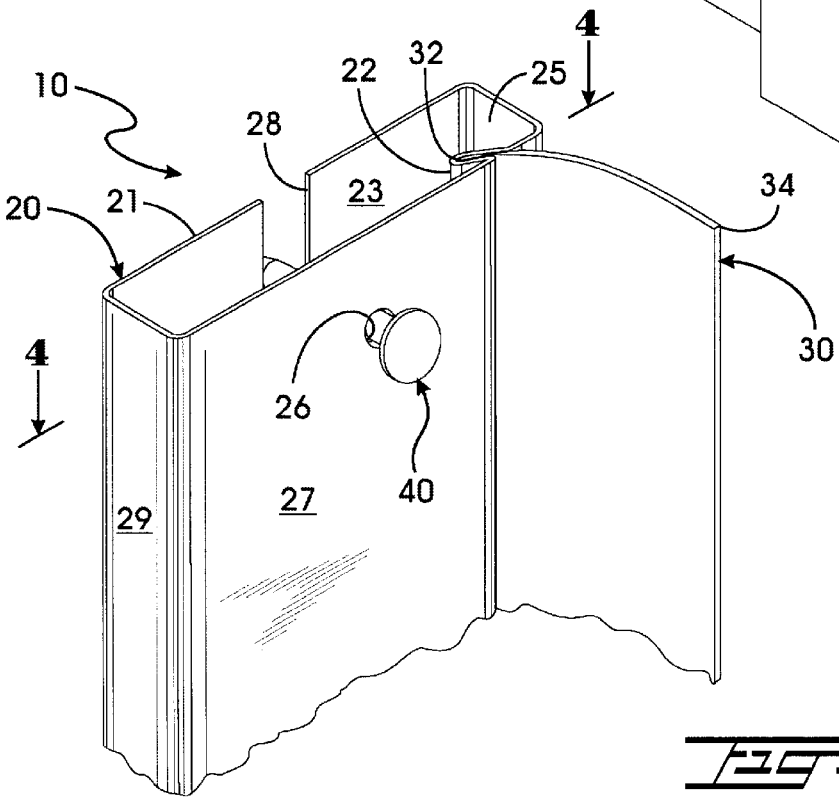
FIG. 2 shows an isometric detail partial view of the invention.
Figure 3:
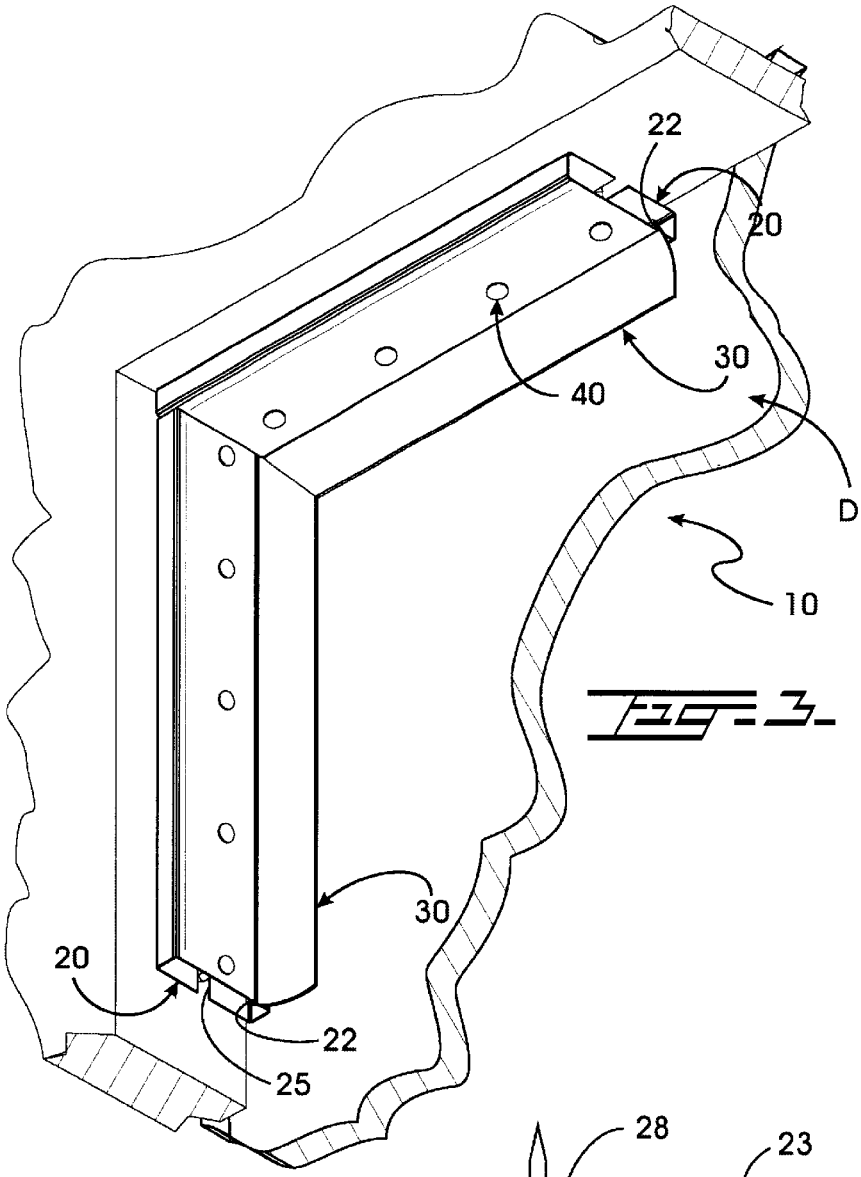
FIG. 3 is a representation of an enlarged detail view of a corner with the trim assembly showing the sealing member in contact with a garage door.
Figure 4:
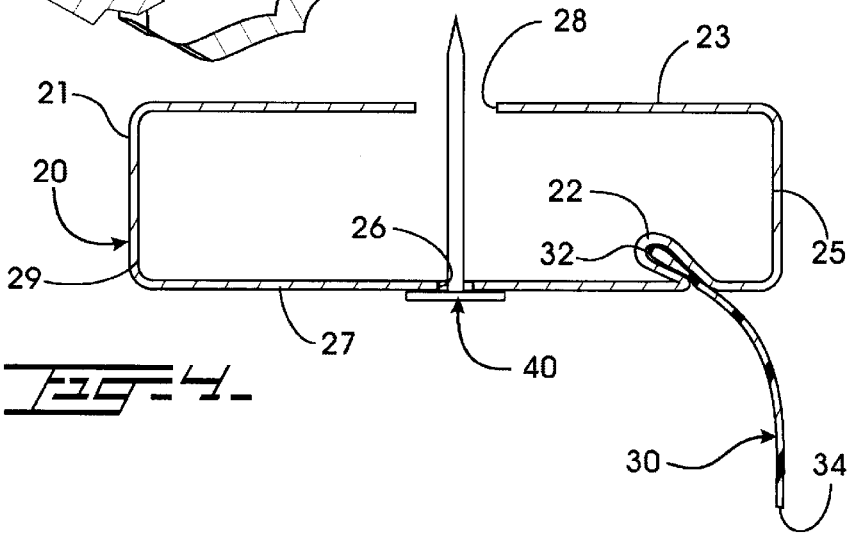
FIG. 4 illustrates cross sectional view of the trim assembly including the sealing member.

Referring now to the drawings, where the present invention is generally referred to with numeral 10, it can be observed that it basically includes elongated trim assembly 20 mounted to wall W and elongated sealing member 30 removably mounted to assembly 20 and its longitudinal distal end coacts with the garage door mounted in the opening being protected. Nail members 40 secure trim assembly 20 to wall W. Nail members 40 can be substituted with screws.

Trim assembly 20 includes longitudinally extending housing 21 with a roll-formed longitudinal bay 22 where sealing member 30 is removable mounted. Housing 21 is mounted on wall W with an opening protected with movable garage door D. The distal longitudinal side 32 of sealing member 30 coacts with door D in a cooperative longitudinally sealing engagement thereon preventing the entry of air, water and/or dust. Sealing member 30 also includes longitudinal side 34 removably receivable within longitudinally extending bay 22.

Sealing member 30 is made out of a resilient material such as rubber. As sealing member 30 deteriorates from its exposure to the elements, it can be slidably removed and a new one readily mounted.

Housing 21 of trim assembly 20 is formed by folding a longitudinal sheet defining longitudinal separation or slot 28 and roll-formed longitudinal bay 22. Housing 21 has a rectangular cross-section with longitudinally extending walls 23; 25; 27 and 29. Wall 23 is secured against wall W. Walls 25 and 29 extend perpendicularly from wall 23 at a parallel and spaced-apart relationship between each other. Wall 27 is at a parallel and spaced-apart relationship with respect to wall 23. Wall 27 includes longitudinally extending bay 22 and a plurality of through openings 26 cooperatively positioned with respect to slot 28 to permit the insertion of nail members 40 therethrough.

Through openings 26 are located at predetermined intervals and they have a cooperative dimensions to permit nails 40 to go through. Nails 40 also go through slot 28 into frame structure defining the opening being protected.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A trim assembly, comprising:

a longitudinally extending housing including a longitudinally extending bay, said housing adapted to be mounted on a structure with an opening being protected with a movable garage door;

a longitudinally extending sealing member having first and second longitudinally extending sides, said first longitudinally extending side being removably receivable within said longitudinally extending bay so that said sealing member is secured by said bay and said second longitudinally extending side adapted to coact with said door in a cooperative longitudinally sealing engagement thereon;

fastening means for securing said housing to said structure;

wherein said housing has a rectangular cross-section with first, second, third and fourth longitudinally extending walls, said first wall being adapted to be secured against said structure, said second and third walls being at a parallel and spaced apart relationship with respect to each other and extending perpendicularly from said first wall, and keeping said fourth wall at a parallel and spaced apart relationship with respect to said first wall, and said longitudinally extending bay being formed in said fourth wall; and wherein said first wall includes a longitudinally extending through slot and said fourth wall includes a plurality of through openings cooperatively positioned with respect to said slot to enable insertion of said fastening means through said housing and into the structure.

2. The trim assembly set forth in claim 1 wherein said fastening means includes a plurality of nails.

3. The trim assembly set forth in claim 2 wherein said sealing member is made out of a resilient material.

4. The trim assembly set forth in claim 3 wherein said sealing member out of rubber.

* * * * *